US008939421B1

(12) United States Patent
Bryson et al.

(10) Patent No.: US 8,939,421 B1
(45) Date of Patent: Jan. 27, 2015

(54) GLIDE FLOOR FOR MERCHANDISING AND DISPLAY OF RETAIL PRODUCTS

(75) Inventors: M. Scott Bryson, Brookfield, WI (US); Dowie Soetenga, Waukesha, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 12/729,768

(22) Filed: Mar. 23, 2010

Related U.S. Application Data

(60) Provisional application No. 61/162,541, filed on Mar. 23, 2009.

(51) Int. Cl.
*A47B 91/00* (2006.01)

(52) U.S. Cl.
USPC ..... 248/346.4; 248/346.01; 248/346.02; 248/346.3; 211/59.2; 211/59.3

(58) Field of Classification Search
USPC ..... 248/346.4, 346.01, 346.02, 346.03, 248/346.06, 346.2, 346.6; 211/59.2, 59.3, 211/74, 175, 184
See application file for complete search history.

(56) References Cited

U.S. PATENT DOCUMENTS

| | | | | |
|---|---|---|---|---|
| 3,654,876 | A * | 4/1972 | Achs | 108/57.16 |
| 4,198,795 | A * | 4/1980 | Barnidge | 52/180 |
| 5,542,552 | A * | 8/1996 | Yablans et al. | 211/59.3 |
| 5,806,689 | A | 9/1998 | Mays et al. | |
| 5,992,651 | A | 11/1999 | Shaw et al. | |
| 6,079,173 | A * | 6/2000 | Waalkes et al. | 52/239 |
| 6,497,185 | B1 * | 12/2002 | Barrett et al. | 108/108 |
| 6,705,236 | B1 * | 3/2004 | Elder | 108/53.3 |
| 7,083,054 | B2 * | 8/2006 | Squitieri | 211/59.2 |
| 7,124,898 | B2 * | 10/2006 | Richter et al. | 211/59.3 |
| 7,182,209 | B2 | 2/2007 | Squitieri | |
| 7,607,628 | B2 * | 10/2009 | Elder et al. | 248/346.02 |
| 7,644,827 | B2 * | 1/2010 | Hanretty | 211/59.2 |
| 8,127,944 | B2 * | 3/2012 | Hardy | 211/59.3 |
| 8,453,850 | B2 * | 6/2013 | Hardy | 211/59.3 |
| 8,739,984 | B2 * | 6/2014 | Hardy | 211/119.003 |
| 2003/0189152 | A1 * | 10/2003 | Elder et al. | 248/346.02 |
| 2005/0040307 | A1 * | 2/2005 | Palmer | 248/346.02 |
| 2005/0127014 | A1 | 6/2005 | Richter et al. | |
| 2005/0133471 | A1 * | 6/2005 | Squitieri | 211/59.2 |
| 2006/0032827 | A1 * | 2/2006 | Phoy | 211/59.2 |
| 2006/0138065 | A1 * | 6/2006 | Squitieri | 211/59.2 |
| 2006/0196840 | A1 * | 9/2006 | Jay et al. | 211/59.2 |
| 2007/0170127 | A1 * | 7/2007 | Johnson | 211/59.3 |
| 2013/0200019 | A1 * | 8/2013 | Hardy et al. | 211/59.3 |
| 2013/0206713 | A1 * | 8/2013 | Hardy | 211/59.3 |
| 2014/0021150 | A1 * | 1/2014 | Hardy | 211/59.3 |
| 2014/0112752 | A1 * | 4/2014 | Hardy et al. | 414/800 |
| 2014/0217042 | A1 * | 8/2014 | Hardy | 211/59.2 |

* cited by examiner

*Primary Examiner* — Terrell McKinnon
*Assistant Examiner* — Monica Millner
(74) *Attorney, Agent, or Firm* — Andrus Intellectual Property Law, LLP

(57) ABSTRACT

A glide floor for use in supporting a number of containers, e.g. for retail display, includes a series of ribs on a top surface defined by the glide floor, in combination with a series of valleys between the ribs. Each rib defines a radiused uppermost tangency point that serves to minimize the contact area between the rib and a bottom surface of each container while providing smooth contact with the bottom surface of the container.

11 Claims, 7 Drawing Sheets

GLIDE FLOOR FOR MERCHANDISING AND DISPLAY OF RETAIL PRODUCTS

CROSS-REFERENCE TO RELATED APPLICATIONS

This application claims priority of U.S. Provisional Patent Application No. 61/162,541, which was filed on Mar. 23, 2009.

BACKGROUND OF THE INVENTION

The present invention relates generally to a glide floor for merchandising and display of products, such as in a retail environment. More specifically, the invention relates to a glide floor that may be used in conjunction with a shelf or display for containers or packages.

Typical glide floors or strips are made from and/or coated with silicone and include ridges that run along the length of the glide floor. The ridges have a number of different configurations, and are adapted to support various containers that may be placed on the glide floor. However, due to the shape of prior art ridges and the material properties of silicone, the glide floors must be placed at an angle of around 10° or more from horizontal in order to enable a container to slide along the glide floor. Such positioning of the glide floor is undesirable because it wastes valuable space that could otherwise be used to display additional products. Moreover, prior art ridges have angular intersection areas that are difficult to clean, often resulting in an undesirable appearance to a potential purchaser. Furthermore, a rectangular ridge design does not effectively resist creep, which is the deformation of the material forming the glide floor. Creep is undesirable because it results in increased friction between the glide floor and a container supported by the glide floor, thus reducing the functionality of the glide floor in enabling containers to smoothly slide along the glide floor under the force of gravity.

Accordingly, it is desirable to position a glide floor at a smaller angle with respect to horizontal so as to maximize the use of space. It is also further desirable to provide a glide floor that reduces creep, which may be achieved by using a specially design rib structure in accordance with the present invention. It is also desirable to provide a glide floor that eliminates angular intersection areas in order to provide easy cleaning. Moreover, it is desirable for glide floors to be releasably attachable to one another so that a variety of shelf sizes may be formed as desired.

SUMMARY OF THE INVENTION

In accordance with one aspect of the invention, a glide floor for use in supporting a number of packages or containers has a plurality of ribs on a top surface defined by the glide floor. There are a plurality of valleys between the ribs. Each rib defines a radiused uppermost tangency point so that two or more ribs engage a lower surface defined by the package or container that is supported by the glide floor. The radiused tangency points of the ribs serve to minimize the contact area between the rib and a bottom surface of each package or container.

In accordance with another aspect of the present invention, a glide floor has a plurality of ribs on a top surface defined by the glide floor. Each rib has an arch-shaped cross section, and there are a plurality of valleys between the ribs. The glide floor is positioned at an angle in the range of 4° to 8° from horizontal, and preferably at an angle of about 6° from horizontal for a conventional merchandising application, such that a package or container will slide downwardly along the glide floor under the force of gravity.

In accordance with another aspect of the invention, a glide floor has a plurality of ribs on a top surface defined by the glide floor, and each rib has an arch-shaped cross section. There are a plurality of valleys between the ribs. The glide floor is in the form of a strip having a tab on one edge and a slot on an edge opposite the edge with the tab. The glide strip includes a slip agent that provides a low coefficient of friction between the glide strip and articles supported on the glide strip. Each rib may have a height of between about 0.01 inch and about 0.1 inch. The distance between ribs may be between about 0.2 inch and about 0.5 inch. The uppermost extent of each rib may have a radius of curvature of between about 0.05 inch and about 0.1 inch.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout.

In the drawings.

DETAILED DESCRIPTION

In a typical prior art application, a glide floor for displaying individual containers in a retail environment is positioned at a relatively steep angle relative to horizontal, in order to enable the containers or packages to slide forward on the glide floor under the force of gravity. In the prior art, a typical glide floor may be positioned at an angle of approximately 10° or more relative to horizontal, to provide forward sliding movement the containers or packages on the glide floor. With this construction, when a customer removes the forwardmost container or package from the glide floor, other containers or packages located rearward of the removed container will slide forward on the glide floor under the force of gravity.

Figure 1:
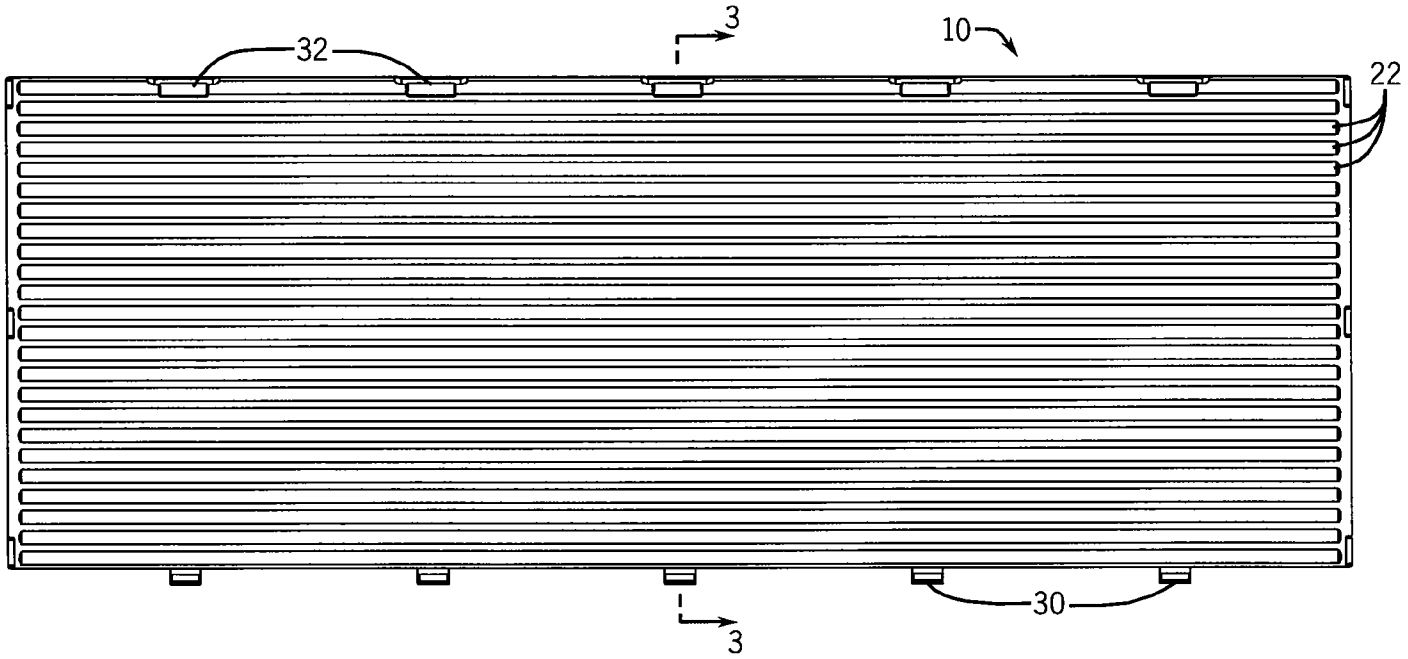
FIG. 1 is a top plan view of a glide floor or tray in accordance with the present invention.

FIG. 1 illustrates a glide floor in the form of a strip or tray 10 of the present invention. Because of the construction and characteristics of the glide strip 10 of the present invention, as will be explained, containers or packages will slide along the glide strip 10 of the present invention when the glide strip 10 is positioned at a much more shallow angle relative to horizontal as compared to prior art glide strips. See, e.g., FIG. 2. Representatively, the containers or packages supported by the glide strip 10 slide forwardly on the glide strip 10 when it is positioned at an angle of between 4° and 8° relative to horizontal, and preferably at an angle of about 6° relative to horizontal, although it is contemplated that the glide strip 10 may function to provide forward sliding movement of containers or packages when the glide strip 10 is positioned at other relatively shallow angles relative to horizontal. In this manner, with the shallower angle provided by the glide strip 10 of the present invention, it is possible for a retailer to use a given space more efficiently, which enables the retailer to either display more types of products or to increase the number of products on display.

Figure 2:
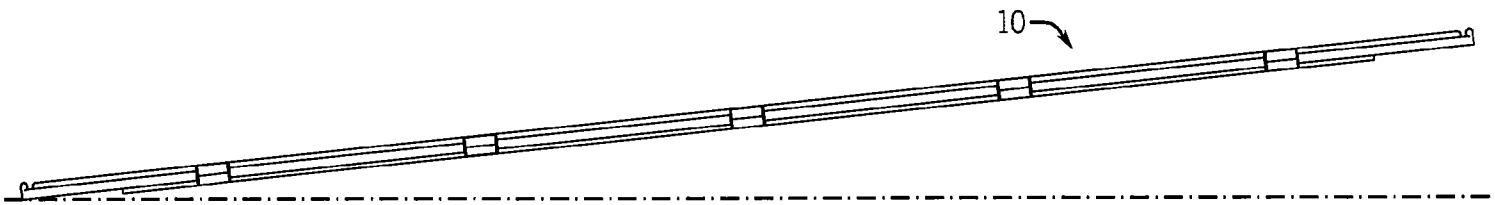
FIG. 2 is a side elevation view of the glide floor of FIG. 1.
Figure 3:
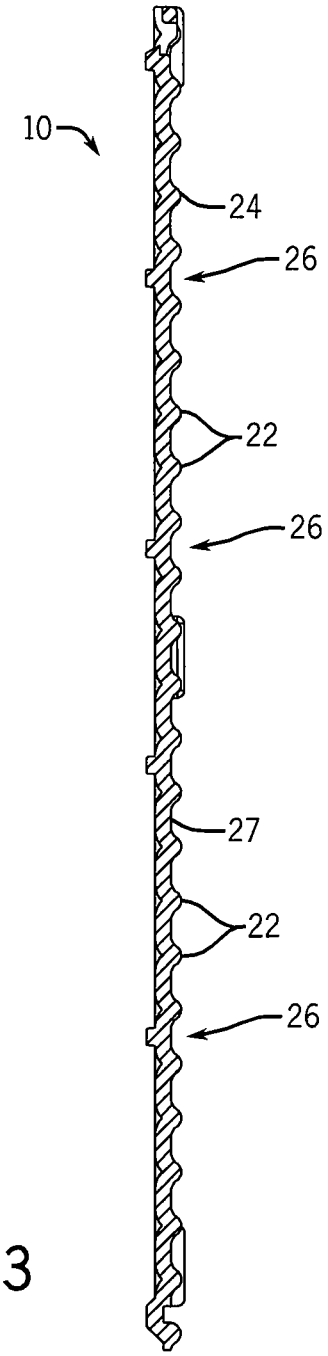
FIG. 3 is an enlarged end elevation view of the glide floor of FIG. 1.

As shown in FIGS. 2 and 3, the glide strip 10 of the present invention may be in the form of a thin, rectangular plate that can be supported in a retail display in any conventional manner. The glide strip 10 has a top surface 20 that includes a series of axially extending ribs 22 that are configured to engage and support the bottom surface of each of a plurality of product containers. The ribs 22 are substantially parallel to one another and extend along a longitudinal axis of the glide strip 10. The ribs 22 preferably extend along substantially the entire length of the glide strip 10. The glide strip 10 may be substantially symmetrical along a longitudinal axis of the glide strip 10.

As shown in FIG. 3, the top surface of the glide strip 10 has a wave-like configuration that defines the ribs 22. Each rib 22 has a convex shape that defines a peak 24, i.e., the highest part of the rib 22, which contacts the bottom surface of a container resting on the glide strip 10. Between the ribs 22 are valleys 26. The valleys 26 merge with the sides of the ribs 22, and have a concave shape. In the illustrated embodiment, the glide strip 10 has a plurality of ribs 22 that support the container or package, and valleys 26 between the ribs 22. Any number of ribs 22 and valleys 26 may be used as desired, in order to provide the optimal balance between the desirable low degree of friction and the weight and pressure of the container or package.

In the illustrated embodiment of FIGS. 1-3, the ribs 22 are spaced apart by a distance (measured between the peaks 24 of two adjacent ribs 22) of between about 2% and about 6% of the width of the glide strip 10. More preferably, the ribs 22 are spaced apart by a distance of about 4% of the width of the glide strip 10. It is understood, however, that the ratio of the width between the ribs 22 and the width of the glide strip 10 may vary according to the parameters of the containers or packages, including weight, bottom footprint, configuration of the portion of the container or package that rests on the ribs, etc. The ribs 22 are spaced so as to minimize the number of contact points with the containers, which minimizes friction and facilitates sliding of containers along the glide strip 10. In addition, the spacing of the ribs 22 makes it easy to clean the glide strip. Specifically, the concave configuration of the valleys 26 and the convex configuration of the ribs 22 provides a smooth cross-section, without sharp corners or crevices, that provides ease of cleaning.

In the illustrated embodiment of FIGS. 1-3, the height of the ribs 22 is between about 0.01 inch and about 0.1 inch, and more preferably about 0.06 inch, although the height of the ribs may vary for different containers or packages. The distance between the ribs 22 is between about 0.2 inch and about 0.5 inch, and more preferably about 0.3 inch, although again the spacing of ribs 22 may vary for different containers or packages. In the embodiment of FIGS. 1-3, the glide strip has a width of about 8 inches. As shown in FIG. 3, the convex top of each rib 22 is preferably rounded, having a radius of curvature of between about 0.05 inch and about 0.1 inch, and more preferably about 0.06 inch. As shown in FIG. 3, the bottom of each valley 26 has a portion 27 that is substantially flat. This flat portion 27 preferably has a width of between about 0.5 inch and about 0.15 inch, and more preferably about 0.1 inch.

The configuration of ribs 22 and valleys 26 provides a top surface of glide strip 10 that minimizes the surface area of the glide strip 10 that is in contact with the bottom surface of a container supported by the glide strip 10. In particular, the radiused peak of each rib 22 provides point-type contact that significantly reduces contact surface area over prior art ribs which have a flat surface upon which the package or container rests, while not digging into the material of the container, and without the package or container digging into the material of the ribs, as could occur with ribs that have a more pointed construction. The radiused peak of each rib 22 functions to deflect or route pressure or stress on the rib 22 from the package or container radially downwardly to the valleys 26, much in the same manner as is accomplished by a Roman arch design. This cross-sectional configuration of the ribs 22 functions to dissipate the force and pressure from the container or package into the valleys 26, and decreases pressure and rib deformation or creep from the weight of the container or package, which greatly enhances the ability of the containers or packages to move by gravity on the ribs 22 when a forward container or package is removed. Creep is undesirable because it presents increased friction between a container and its supporting surface, and thereby can inhibit the sliding movement of the containers along a shelf or other support structure. By eliminating creep, as mentioned above, the glide strip 10 of the present invention does not have to be as steeply angled as is the case with known prior art glide strips. Specifically, the glide strip 10 of the present invention can be positioned at an angle of about 6° relative to horizontal, although it is understood that the glide strip 10 may be positioned at any other desired, relatively low angle relative to horizontal.

At least the upper surface of the glide strip 10 of the present invention is formed of a low friction material, which further facilitates the forward sliding movement of containers on the glide strip 10 when a forwardmost one of the containers is removed. Representatively, the upper surface of the glide strip 10 may be formed of a Teflon material such as a DuPont Teflon® Grade 7B Granular Compression Molding Resin or an ABS plastic material incorporating a low friction agent such as Siloxane, although it is understood that any other satisfactory low friction material may be employed. The glide strip 10 may be over-molded, coated, sprayed, or simply made of a low friction material. Alternatively, the glide strip 10 may be made of a material that includes a low friction additive such as a Teflon or Siloxane material. This is an improvement over prior art glide strips, which are typically made from or coated with silicone. However, it has been found that silicone has a tendency to deteriorate over time, thus preventing containers from sliding along the glide strip. The materials used in the present invention, on the other hand, deteriorate much more slowly than silicone, thus maintaining the preferable low friction properties of the glide strip 10 that allow containers to easily slide down the glide strip even when positioned at a shallow angle as described.

Figure 9:
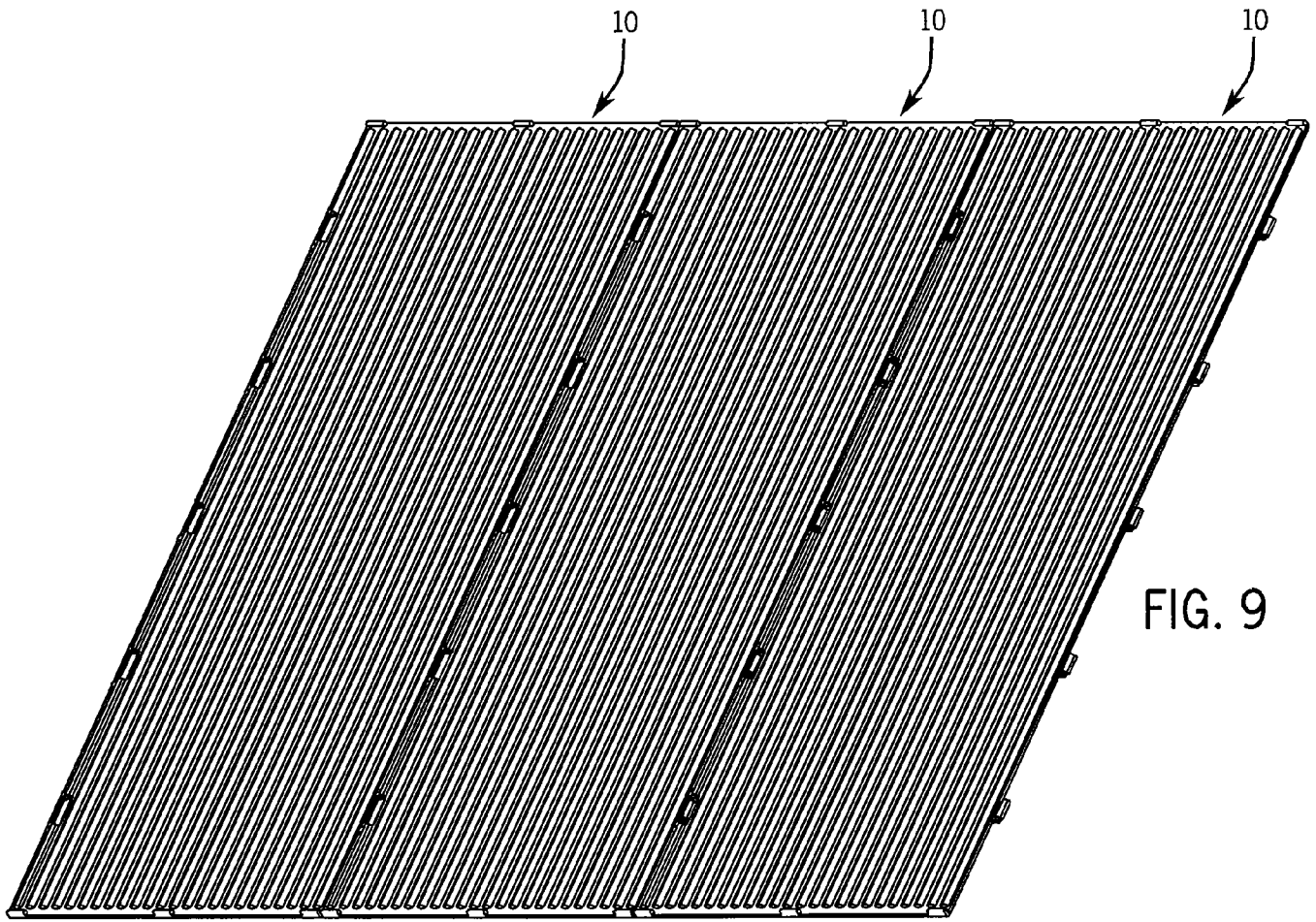
FIG. 9 is an isometric view of a series of glide floor sections interconnected together.

The glide strip 10 may further be releasably attachable to other adjacent glide strips 10. Thus, as shown in FIG. 9, a desired number of glide strips 10 may be assembled together in order to provide a floor surface for supporting various containers or other items. Accordingly, the releasably attachable glide strips 10 are modular components that may be used to form a variety of different shelf sizes depending on the nature and dimensions of the storage area with which the glide strips 10 are being used. As shown in FIG. 1, the glide strip includes a plurality of tabs 30 along on one edge of the glide strip 10 and a plurality of slots 32 along an opposite edge. The slots 32 are sized to releasably receive the tabs 30. As shown in FIG. 1, each tab 30 has a lip that extends toward the ribbed surface of the glide strip 10. In such an arrangement, the tab 30 is inserted from beneath the ribbed surface such that the tab 30 protrudes upwardly through the slot 32. The tab 30 and slot 32 may be dimensioned such that a releasable press fit is formed when the tab 30 is inserted into the slot. The glide strip 10 may have one or more tab 30 and slot 32 pairings. The tab/slot configuration is only one example of how the glide strips 10 may be releasably connected to one another. Any suitable means may be used.

Figure 7:
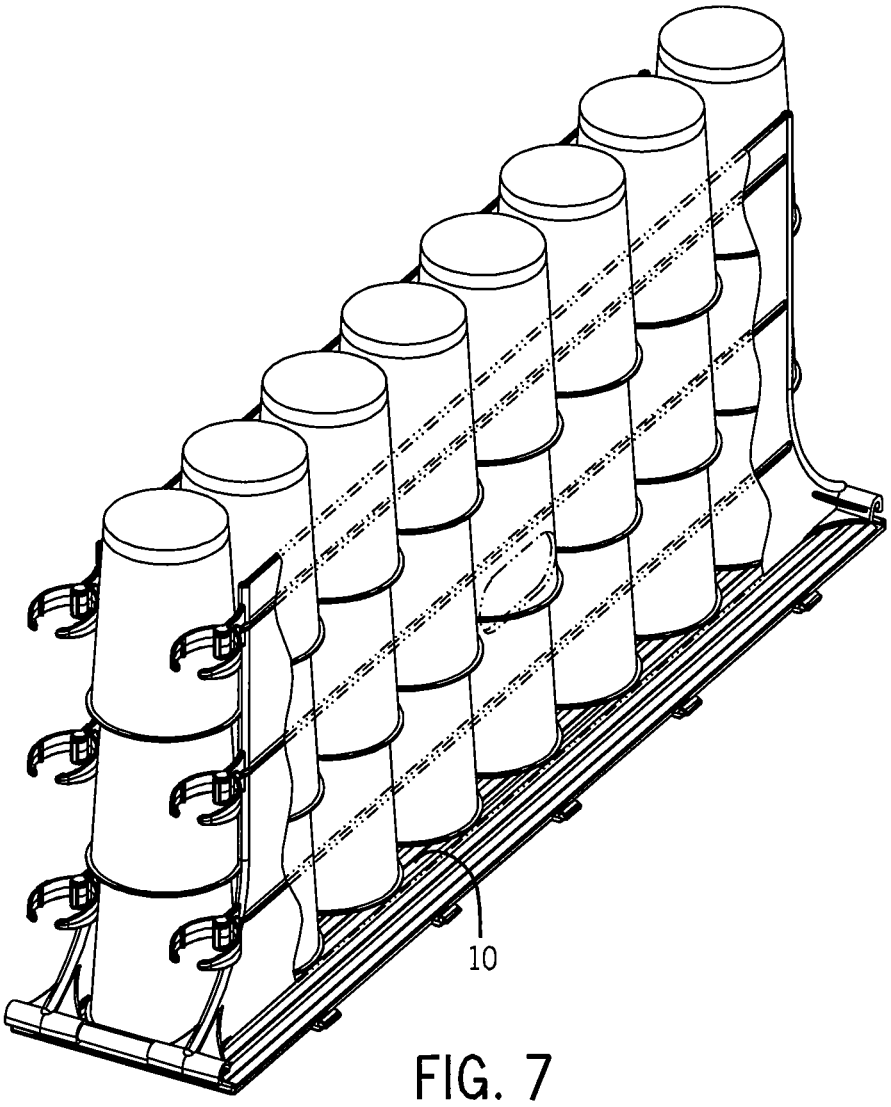
FIGS. 7 and 8 are isometric views illustrating representative applications of the glide floor of FIGS. 1-3.
Figure 8:
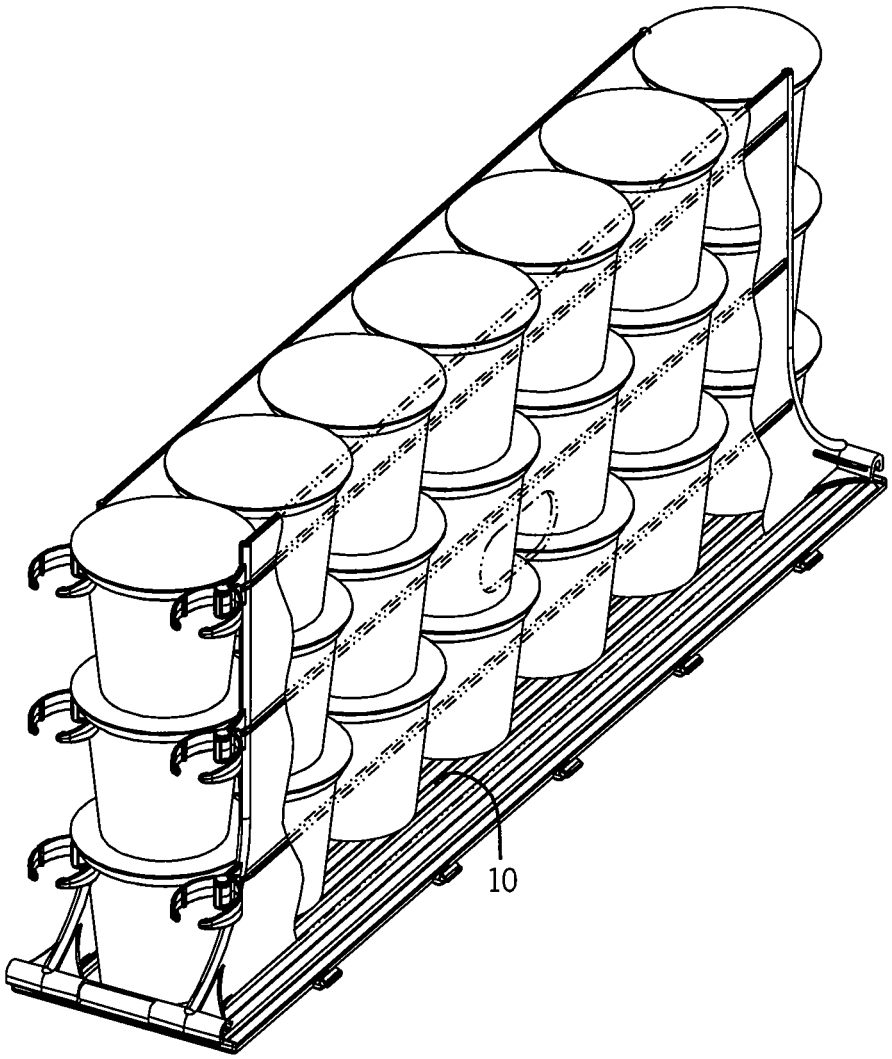

FIGS. 7 and 8 illustrate a representative application of glide strip 10. In this application, the glide strip 10 supports the bottoms of a series of packages or containers, such as yogurt containers, which are supported on their sides by support rails that extend upwardly from the glide strip 10. The glide strip 10 may be provided with a front stop to position the forward-most package or container in a desired position within the display, and the support rails may also be provided with stops that prevent forward movement of the packages or containers. It should be understood, however that the glide strip 10 may be used in connection with the display of any type of package or container, and is not limited to use with yogurt containers. The glide strip 10 may be used to support packages or containers made of a variety of materials, e.g., glass, plastic, metal, etc. The glide strip 10 may also be used in conjunction with a variety of shelf sizes and configurations for various packages or containers.

Figure 4:
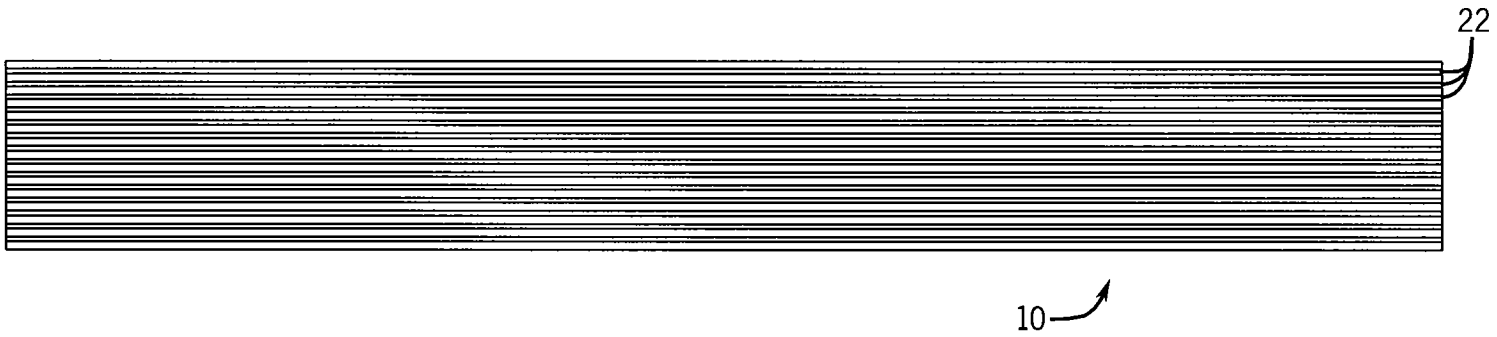
FIG. 4 is a top plan view of a second embodiment of a glide floor or tray in accordance with the present invention.
Figure 5:
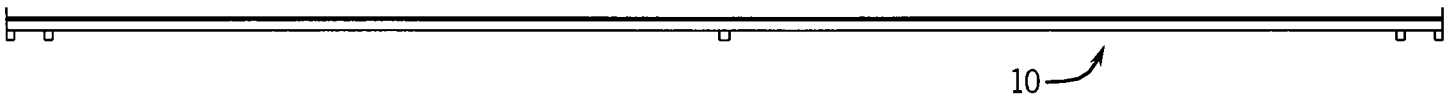
FIG. 5 is a side elevation view of the glide floor of FIG. 4.
Figure 6:
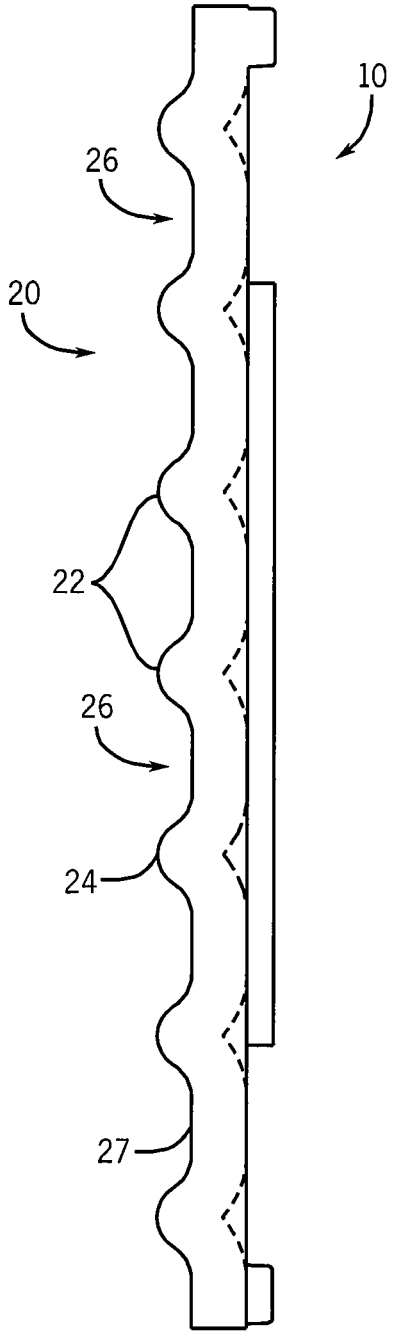
FIG. 6 is an enlarged end elevation view of the glide floor of FIG. 4.

FIGS. 4-6 illustrate another embodiment of the present invention that includes ribs 22 and valleys 26. In this embodiment, the height of the ribs 22 is between about 0.01 inch and about 0.1 inch, and more preferably about 0.06 inch. The distance between the ribs 22 is between about 0.2 inch and about 0.5 inch, and more preferably about 0.3 inch, although again the spacing of ribs 22 may vary for different containers or packages. This spacing allows for about 7 ribs 22 on a glide strip 10 having a width of about 2.5 inches. As shown in FIG. 6, the convex top of each rib 22 is preferably rounded, having a radius of curvature of between about 0.05 inch and about 0.1 inch, and more preferably about 0.122 inch. The concave rounded side walls of the ribs 22 preferably have a radius of curvature of between about 0.05 inch and about 0.2 inch, and more preferably about 0.125 inch. As shown in FIG. 6, the bottom of each valley 26 has a portion 27 that is substantially flat. This flat portion 27 preferably has a width of between about 0.03 inch and about 0.09 inch, and more preferably about 0.06 inch. Accordingly, the ribs 22 are spaced apart by a distance (measured between the peaks 24 of two adjacent ribs 22) of between about 10% and about 20% of the width of the glide strip 10. More preferably, the ribs 22 are spaced apart by a distance of about 13% of the width of the glide strip. Thus, in the embodiment of FIGS. 4-6, the ribs 22 are relatively widely spaced apart from one another, particularly when compared to known prior art configurations (not shown). The wide spacing between the ribs 22 minimizes the number of contact points with the containers, and facilitates sliding of containers along the glide strip 10. In addition, the wide spacing of the ribs 22 makes it easy to clean the glide strip. Specifically, the concave configuration of the valleys 26 and the convex configuration of the ribs 22 provide a smooth cross-section, without sharp corners or crevices, that provides ease of cleaning.

The glide floor of the present invention is designed according to the parameters and characteristics of the supported containers or packages in order to provide optimal operation. That is to say, the glide floor may be designed to have any number of ribs greater than two in contact with the bottom of the container or package, according to container variables including container type (flexible or rigid), weight, surface area, material and finish.

The present invention thus provides a glide floor that has a number of advantages for use in a retail merchandising application. The glide floor is easy to clean by virtue of the undulating wave-like concave-convex configuration of the valleys and ribs, without the presence of sharply angled corners, cracks or crevices that tend to trap dirt, spillage, etc. The present invention also provides a superior use of a low drag coefficient material for a gravity fed product merchandising system in a supermarket, grocery store or other retail application. It is believed that the glide floor of the present invention will have significant longevity due to its unique geometry which prevents deformation of the container engagement areas of the glide strip, as well as due to its material characteristics and ease of cleaning, in contrast to prior art glide floors that are used in similar applications.

Various alternatives and modifications are contemplated as being within the scope of the following claims particularly pointing out and distinctly claiming the subject matter regarded as the invention.

We claim:

1. A glide floor for use in supporting a number of packages or containers, comprising:

a plurality of ribs on a top surface defined by the glide floor, each rib having an arch-shaped cross section;

a plurality of valleys between the ribs, wherein the plurality of ribs and the plurality of valleys create a continuous surface of the glide floor; and a tab on one edge of the glide floor and;

a slot on an edge of the glide floor opposite the tab;

wherein the glide floor includes a low friction material;

wherein each rib has a height of between about 0.01 inch and about 0.1 inch;

wherein the distance between ribs is between about 0.2 inch and about 0.5 inch;

wherein the uppermost extent of each rib has a radius of curvature of between about 0.05 inch and about 0.1 inch.

2. The glide floor of claim 1, wherein each rib has a convex cross section.

3. The glide floor of claim 2, wherein the valleys between the ribs have a concave cross section.

4. The glide floor of claim 3, wherein the valleys and ribs merge at angled transition areas between the valleys and ribs.

5. The glide floor of claim 1, wherein the glide floor is positioned at an angle of between 4° and 8° from horizontal.

6. The glide floor of claim 5, wherein the glide floor is positioned at an angle of 6° from horizontal.

7. The glide floor of claim 1, wherein the glide floor has a width of about 8 inches.

8. The glide floor of claim 1, wherein each valley has a substantially flat portion.

9. The glide floor of claim 8, wherein for each valley the flat portion has a width of between about 0.05 inch and about 0.15 inch.

10. The glide floor of claim 1, wherein the glide floor has a smooth cross section with respect to the ribs and valleys.

11. The glide floor of claim 1, wherein the glide floor is one of a plurality of glide floors wherein the glide floors are secured together by tab-slot connection.

* * * * *